United States Patent [19]

Hedge

[11] Patent Number: 4,741,715

[45] Date of Patent: May 3, 1988

[54] PRESSURE ACTUATED DRAIN VALVE FOR MARINE DRIVE

[75] Inventor: George C. K. Hedge, Oshkosh, Wis.

[73] Assignee: Brunswick Corporation, Skokie, Ill.

[21] Appl. No.: 947,599

[22] Filed: Dec. 30, 1986

[51] Int. Cl.[4] ..... B63C 9/08

[52] U.S. Cl. ..... 440/88; 440/113

[58] Field of Search ..... 440/88, 89, 113, 900; 114/183 R, 183 A, 185, 197, 198

[56] References Cited

U.S. PATENT DOCUMENTS

| | | | |
|---|---|---|---|
| 271,060 | 1/1883 | Graham | 114/185 |
| 2,350,598 | 6/1944 | Faville | 114/198 |
| 2,655,121 | 10/1953 | Cuneo | 114/197 |
| 2,884,888 | 5/1959 | Pujol | 114/185 |
| 2,959,144 | 11/1960 | Youtie | 114/185 |
| 2,966,525 | 4/1949 | Wilson | 440/88 |
| 2,966,875 | 1/1961 | Irey | 114/185 |
| 3,011,468 | 12/1961 | O'Gara | 114/185 |
| 3,067,714 | 12/1962 | Allmand | 114/185 |
| 3,550,612 | 12/1970 | Maxon | 440/88 |
| 3,875,888 | 4/1975 | Bier | 114/185 |
| 4,357,912 | 11/1982 | Brown | 440/900 |

*Primary Examiner*—Joseph F. Peters, Jr.
*Assistant Examiner*—Stephen P. Avila
*Attorney, Agent, or Firm*—Andrus, Sceales, Starke & Sawall

[57] ABSTRACT

A pressure actuated drain valve for automatically draining the cooling water from a marine drive engine when the engine is stopped. The drain valve includes a spring-loaded diaphragm which moves to a closed position when the engine water pump is operating to close an outlet from the engine cavities to be drained. The diaphragm automatically moves to its open position when the engine water pump is off to open the outlet to allow cooling water to drain from the engine cavities.

6 Claims, 2 Drawing Sheets

PRESSURE ACTUATED DRAIN VALVE FOR MARINE DRIVE

BACKGROUND OF THE INVENTION

The present invention relates to marine drives, and more particularly to a valve for automatically draining the cooling water from a marine engine when the engine is stopped.

Various types of drain valves are typically used in a marine environment. For example, drain valves referred to as "self-bailers" or automatic bilge valves for attachment to the bottom of a boat which operate on the suction principle are well known. Such bailers typically include an exhaust aperture which, in use, is directed toward the rear or stern of the boat. Water collecting in the boat is discharged through the exhaust aperture by means of suction created by movement of the boat through the water. Examples of such devices may be found in the following U.S. patents: No. 271,060 to Graham; No. 2,655,121 to Cuneo; No. 2,884,888 to Pugol; No. 2,959,144 to Youtie; No. 2,966,875 to Irey; No. 3,011,468 to O'Gara; No. 3,067,714 to Allmand; and No. 3,875,888 to Bier.

Drain valves, however, have not been up to this point commonly used with recreational marine drive engines which utilize seawater for cooling. In standard arrangements, cooling water drainage is accomplished by allowing gravity to cause the cooling water to flow out of the engine through an orifice in the engine housing which is always open. Nevertheless, in several prior known marine drive engines, namely, the "MerCruiser", 60, 80, and 90 engines sold by the assignee of the present invention, there was used a floating plastic ball for opening and closing a drain circuit. These plastic balls floated upward within a ported cavity to close the drain circuit when cooling water was pumped to the engine. In turn, when the water pump stopped, gravity caused the cavity containing the ball to drain thus uncovering the drain circuit and draining cooling water from the engine.

Such floating ball drain valves have several inherent disadvantages due to their principle of operation. Most noticeably, the forces which made the ball float were relatively small making the valve's operation erratic when the environment departed from a new, clean condition. Since the ball chamber was directly in the flow path of the cooling water it could "see" any debris ingested by the pump, and, because of the chamber's shape, the debris could be accummulated in the chamber to the extent that the ball's desired motion was either impeded or prevented. The result was to produce either overheating or loss of drainage depending upon the ball's position at the time of debris accummulation. A loss of drainage also could result in accelerated corrosion if the engine is being used in salt water.

SUMMARY OF THE INVENTION

A pressure actuated drain valve for a marine drive engine which automatically drains cooling water from the engine when the engine is stopped.

The drain valve includes a spring loaded flexible sealing member in the form of a diaphragm which is normally biased in its open position and movable to a closed position in response to fluid pressure in the cooling circuit when the engine water pump is operating. In its open position, cooling water is allowed via gravity to flow out of the engine cavities through an outlet in the engine housing. In its closed position, the diaphragm covers the outlet to prevent cooling water drainage so long as the water pump is operating. Preferably, the diaphragm is substantially in the form of a truncated cone and seats against correspondingly shaped walls in a valve chamber, and includes a small diameter opening positioned over the outlet which permits minimal drainage to occur even while the pump is operating to insure proper sealing action.

The drain valve of the present invention overcomes the disadvantages of prior "floating ball" arrangements since it is pressure actuated allowing for higher forces to be used during operation which results in a more dependable operation, particularly in dirty environments. Additionally, the actuation and sealing forces of the present device are significantly greater than the "floating ball" design due to the greater difference in seating area of a diaphragm versus a floating ball. Further, the present device does not have its sealing element in the primary flow path making the accummulation of debris less likely. Finally, the movable sealing element of the present device is also less sensitive to debris accummulation than a floating ball.

The present invention thus provides a pressure actuated drain valve for a marine drive engine which will automatically and reliably drain the cooling water from the engine cooling circuit when the engine is stopped. In addition to the above noted advantages, the present device improves corrosion resistance and simplifies winterization of the engine thus increasing engine life and reducing owner expenses.

BRIEF DESCRIPTION OF THE DRAWINGS

The drawings illustrate the best mode presently contemplated of carrying out the invention.

In the drawings.

DESCRIPTION OF THE PREFERRED EMBODIMENT

Figure 1:
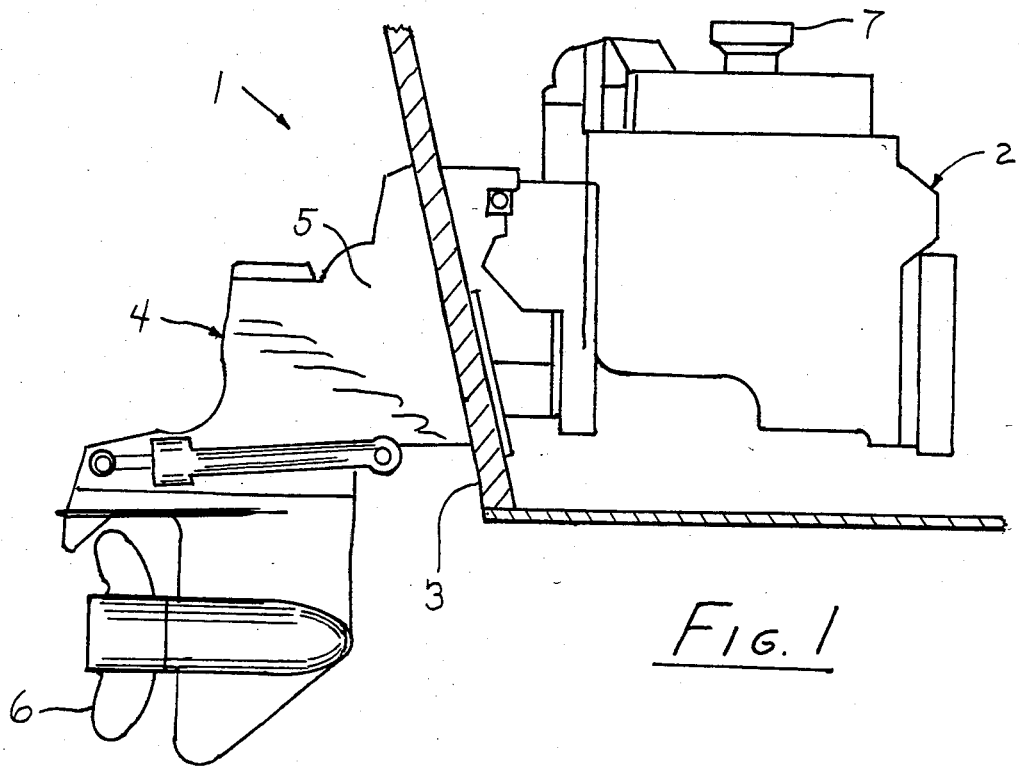
FIG. 1 is a fragmentary side view in elevation illustrating a typical V-6 marine stern drive incorporating a drain valve in accordance with the present invention.

Referring now to the drawings, FIG. 1 illustrates a marine propulsion system, generally designated by the numeral 1, having a water cooled, six cylinder, internal combustion engine 2 drivingly connected through a boat transom 3 to stern gear drive 4 having gear drive housing 5 for rotating propeller 6. Fuel supply is provided by a fuel pump (not shown) drawing fuel from a remote tank (not shown) and delivering the fuel to carburetor 7 for combustion within engine 2. It should be noted that although the present invention is shown as being utilized with V-6 engine 2, it may be utilized with various other forms of marine drive systems incorporating an engine water cooling system which draws cooling water from an external seawater location, namely, the lake, sea or ocean in which the boat is being utilized.

Figure 2:
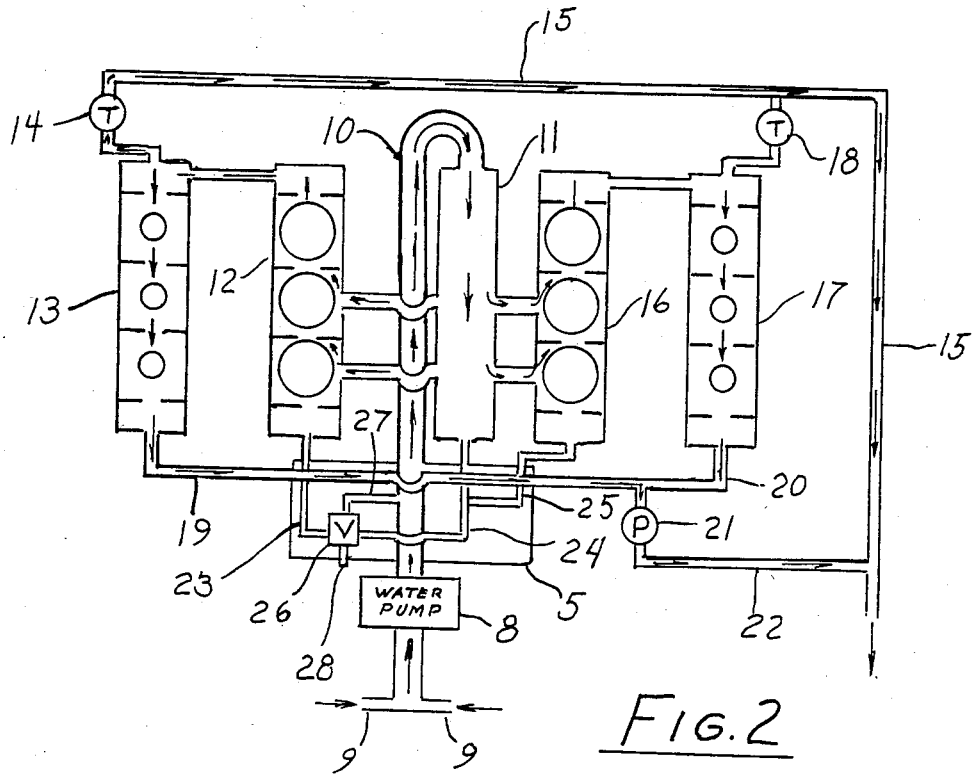
FIG. 2 is a schematic flow diagram illustrating the cooling water flow circuit for the V-6 stern drive shown in FIG. 1.

Referring now to FIG. 2, there is illustrated in schematic form a flow diagram of the water flow in the cooling system or circuit for engine 2 shown in FIG. 1. More particularly, upon start up of engine 2, pump 8 draws water through a pair of lower seawater inlets 9 and forces it through a main passage 10 to exhaust manifold cover 11. Since engine 2 is a V-6 design, water passes through port side cylinder block 12 and then through port side cylinder head 13, and finally through thermostat 14 into water discharge line 15. Likewise, cooling water from manifold cover 11 also passes through starboard side cylinder block 16, and then through starboard side cylinder head 17 and finally through starboard thermostat 18 into discharge line 15 where it returns to the lake, sea or ocean. Cooling water from cylinder head 13 also passes into line 19 and cooling water from cylinder head 17 also passes into line 20 and then through a water pressure relief valve 21 of the poppet valve type into line 22 which in turn communicates with water discharge line 15.

In order to drain the cooling system or circuit for engine 2, drain passages 23, 24 and 25 are provided. Drain passage 23 communicates from the port side cylinder block 12 to one side of a drain valve 26, and drain passage 24 communicates between exhaust manifold cover 11 and the other side of drain valve 26. Drain passage 25 in turn communicates between the starboard side cylinder block 16 and drain passage 24. As shown, a pilot pressure line 27 also communicates between main passage 10 and drain valve 26, and an outlet 28 communicates from valve 26 through gear drive housing 5 to a location externally of gear drive 4 so that upon drainage, water flows back into the lake, sea or ocean.

Figure 3:
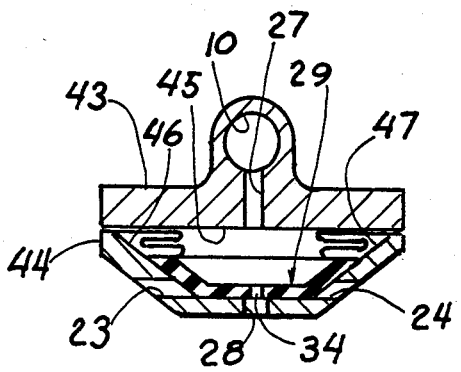
FIG. 3 is a fragmentary view in cross section illustrating the drain valve in its closed position.
Figure 4:
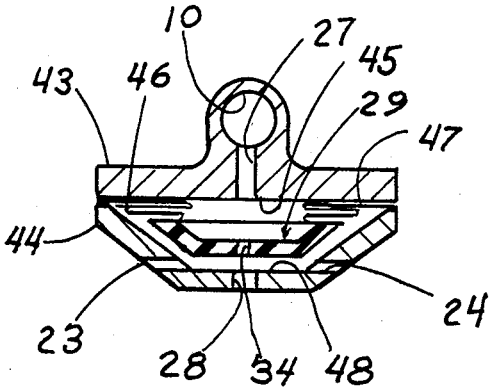
FIG. 4 is a view similar to FIG. 3 illustrating the drain valve in its open position.
Figure 5:
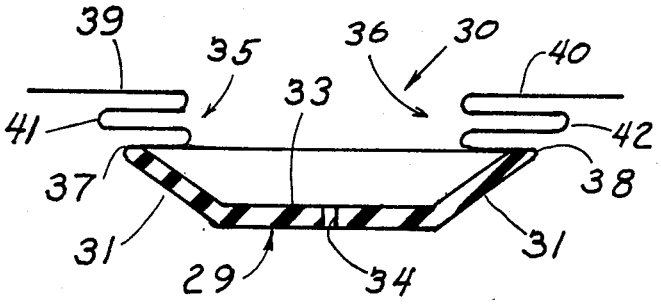
FIG. 5 is an enlarged cross sectional view of the spring loaded diaphragm utilized with the drain valve of FIGS. 3 and 4.

Referring now to FIGS. 3-5, there is shown a preferred embodiment of drain valve 26. As illustrated, drain valve 26 includes a flexible sealing element in the form of a truncated cone shaped rubber diaphragm 29, and a spring 30 for biasing diaphragm 29 in its open position, as shown in FIG. 4. As shown best in FIG. 5, diaphragm 29 includes a substantially flat disc-shaped or circular web portion 33 having a cylindrically shaped wall portion 31 extending from the periphery of web portion 33. Wall portion 31 is inclined outwardly with respect to web 33 at an angle, as illustrated, of about 30°, and web 33 includes an opening 34 located centrally therein over outlet 28 having a diameter of approximately 0.06 inches. Opening 34 allows for cooling water to leak past diaphragm 29 even when diaphragm 29 is in its closed position, as shown in FIG. 3, so as to provide an adequate sealing function and to allow drainage of passage 27.

Spring 30 is composed of a pair of S-shaped spring members 35, 36, which include lower legs 37, 38 attached to legs 31, 32 respectively of diaphragm 29, upper legs 39, 40 and S-shaped central portions 41, 42 which provide the spring force therefor. Members 35, 36 may be made of any corrosion resistant material such as stainless steel having sufficient resiliency to act as a spring for diaphragm 29.

As shown best in FIGS. 3 and 4, upper legs 39, 40 of spring members 35, 36 are sandwiched between a pair of housing members 43, 44 for securely mounting diaphragm 29 in its proper location within a chamber 45 defined thereby. Chamber 45 includes a pair of opposite inclined walls 46, 47 which communicate with drain passages 23, 24 respectively, and a lower flat wall 48 which communicates with outlet 28. Walls 46 and 47 are inclined outwardly with respect to wall 48 to form a correspondingly shaped seat for diaphragm 29 which allows for adequate sealing of passages 23-25 in its closed position, as shown in FIG. 3. Drain passages 23-25 as well as outlet 28 communicate with one side of diaphragm 29 while main passage 10 and pilot pressure line 27 communicate with the opposite side of diaphragm 29.

In operation, when pump 8 is operational, fluid pressure in main passage 10 is communicated via line 27 to one side of diaphragm 29 causing diaphragm 29 to seal passages 23-25 and outlet 28. Due to the dimensions of line 27, approximately 0.5 psig is available above diaphragm 29 to actuate the sealing function of diaphragm 29. On the other hand, when pump 8 is shut off, diaphragm 29 moves to its open position via the force of spring 30 to allow drainage of cooling water from passages 23-25 through outlet 28.

Various modes of carrying out the invention are contemplated as being within the scope of the following claims particularly pointing and distinctly claiming the subject matter which is regarded as the invention.

I claim:

1. In a marine propulsion drive system having an engine with a water cooling system for cooling the engine including a cooling water pump actuatable between an operating state to pump cooling water through said cooling water system when said engine is running and a non-operating state when said engine is off, and a water drainage system for draining the cooling water including drain passages leading to an outlet, a drain valve for the cooling water drainage system comprising:

a flexible sealing member normally biased to an open position to permit water drainage through said outlet when said cooling water pump is in its non-operating state and movable to a closed position when said cooling water pump is in its operating state to prohibit water drainage through said outlet; and means for actuating said sealing member to its closed position in response to fluid pressure in said water cooling system developed by the operation of said cooling water pump.

2. The system of claim 1 wherein said sealing member comprises a spring loaded diaphragm.

3. The system of claim 2 wherein said diaphragm is shaped in the form of a truncated cone.

4. The system of claim 3 wherein said diaphragm includes a flat central web portion having a small diameter opening extending therethrough.

5. The system of claim 1 wherein said actuating means includes a pressure line communicating between said cooling system and one side of said sealing member, and said outlet and drain passages communicate with the opposite side of said sealing member.

6. The system of claim 3 further including a seat for receiving said diaphragm.

* * * * *